US008387639B2

(12) United States Patent
Troxel et al.

(10) Patent No.: US 8,387,639 B2
(45) Date of Patent: Mar. 5, 2013

(54) CANTILEVERED CANOPY

(75) Inventors: Christopher Troxel, Dunwoody, GA (US); Paul Jankowski, Woodstock, GA (US)

(73) Assignee: Retractable Awning Canopy Company, LLC, Atlanta, GA (US)

( * ) Notice: Subject to any disclaimer, the term of this patent is extended or adjusted under 35 U.S.C. 154(b) by 0 days.

(21) Appl. No.: 13/052,494

(22) Filed: Mar. 21, 2011

(65) Prior Publication Data

US 2011/0232711 A1 Sep. 29, 2011

Related U.S. Application Data

(60) Provisional application No. 61/341,137, filed on Mar. 29, 2010.

(51) Int. Cl.
*E04H 15/06* (2006.01)

(52) U.S. Cl. ..... 135/88.07; 135/143; 135/151

(58) Field of Classification Search ..... 135/143, 135/151, 153, 155, 88.07, 88.13, 88.14, 88.16, 135/88.17; 296/160, 161, 163
See application file for complete search history.

(56) References Cited

U.S. PATENT DOCUMENTS

| | | | | |
|---|---|---|---|---|
| 1,493,915 | A * | 5/1924 | Baker | 135/146 |
| 2,154,467 | A * | 4/1939 | Munger | 296/161 |
| 2,778,369 | A * | 1/1957 | Tang | 135/153 |
| 2,859,756 | A * | 11/1958 | Barnes | 135/88.07 |
| 3,186,420 | A * | 6/1965 | Magee | 135/88.07 |
| 3,844,300 | A * | 10/1974 | Sanders | 135/88.16 |
| 4,099,534 | A * | 7/1978 | Corbin | 135/150 |
| 5,579,797 | A * | 12/1996 | Rogers | 135/90 |
| 7,931,040 | B2 * | 4/2011 | Holacka et al. | 135/154 |
| 2008/0230104 | A1 * | 9/2008 | Potter et al. | 135/88.14 |

FOREIGN PATENT DOCUMENTS

WO WO 8204383 A1 * 12/1982

* cited by examiner

*Primary Examiner* — Noah Chandler Hawk
(74) *Attorney, Agent, or Firm* — Wood, Herron & Evans, LLP

(57) ABSTRACT

A portable canopy is attachable to the roof rack of a vehicle and designed to unfold outwardly over the rear of the vehicle supported in a cantilevered fashion from the roof rack. The canopy does not require separate legs or other ground support other than the roof rack of the automobile.

11 Claims, 10 Drawing Sheets

CANTILEVERED CANOPY

RELATED APPLICATION

This application is related to and claims the benefit of U.S. Provisional Patent Application Ser. No. 61/341,137, filed Mar. 29, 2010, the disclosure of which is incorporated herein by reference.

BACKGROUND OF THE INVENTION

Canopies and awnings are utilized at a variety of different events. Tailgaters frequently set up temporary canopies. But, these take up interior space of the vehicle to transport them to the event. Because they must be supported on four legs, they interfere with movement of traffic.

SUMMARY OF THE INVENTION

The present invention is premised on the realization that a canopy or awning can be supported from the luggage rack of a vehicle to provide shading behind the vehicle and further be stored and transported on the luggage rack. More particularly, the luggage rack of the present invention is supported on the luggage rack and unfolds from the stored position on the luggage rack out over the back of the vehicle and does not require separate legs to support the canopy. The system is designed to be deployed from the rear of a vehicle by a single person and thus provide a shaded area for tailgating or recreational uses. Preferably, the canopy has a generally triangular configuration.

The objects and advantages of the present invention will be further appreciated in light of the following detailed description and drawings in which:

DETAILED DESCRIPTION

Figure 1:
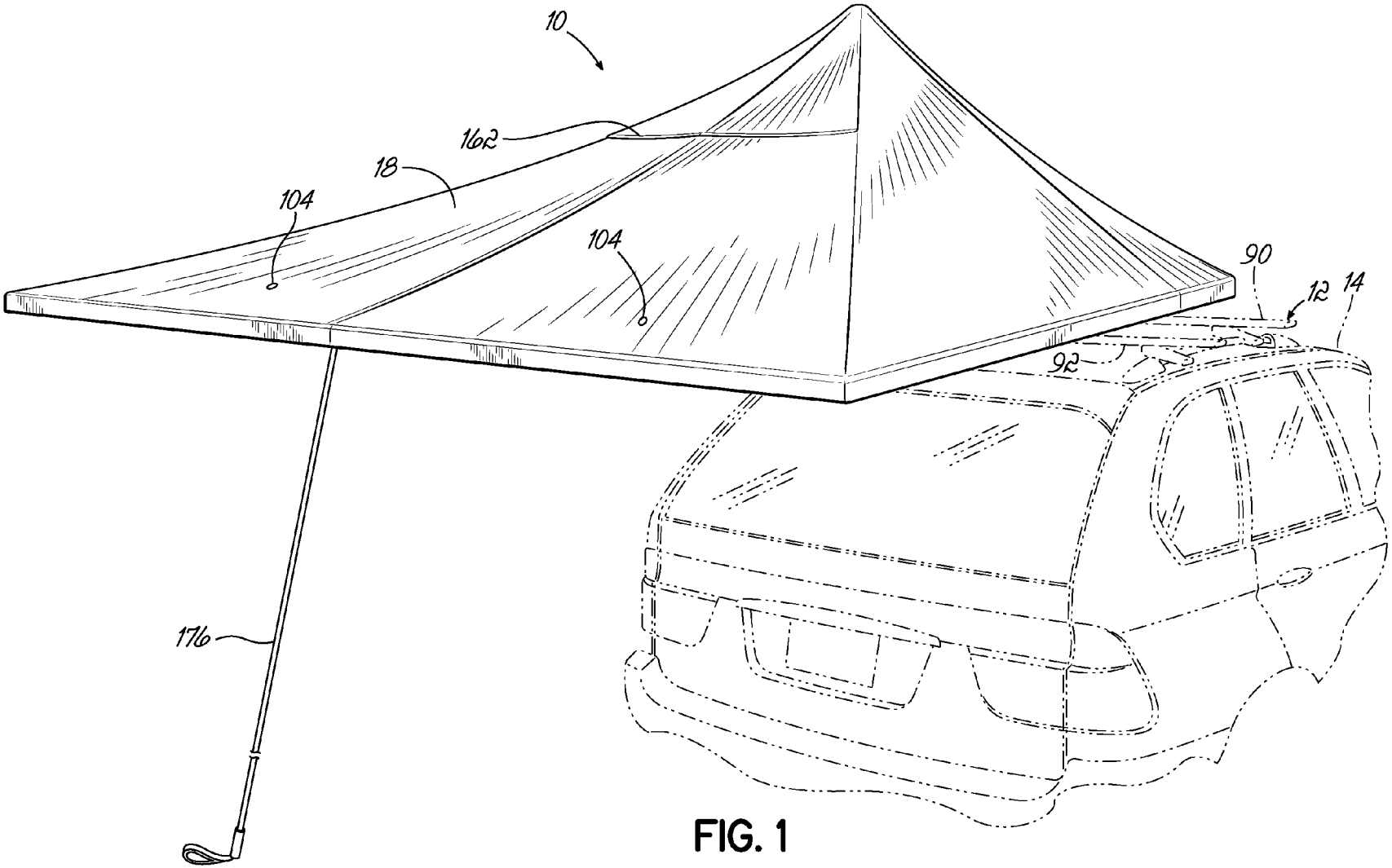
FIG. 1 is a perspective view of the present invention with its environment in phantom.

As shown in the attached drawings, the present invention is a canopy 10 designed to attach to the roof rack 12 of a car or sports utility vehicle 14.

The canopy 10 includes a frame 16 and a cover 18 fixed to the frame. The canopy can be formed from many different materials. One material particularly suitable is a rip stop nylon such as taffeta nylon. The frame members are simply tubes and can be steel, aluminum or plastic reinforced with fiberglass or carbon fiber.

The frame 16 includes a base frame portion 20 which includes first side frame member 22, second side frame member 24, and an end frame member 26. The three of these when in an extended position, as shown FIG. 1, form a generally triangular shape. The base frame portion 20 also includes first and second internal frame members 28 and 30. Extended from the base frame portion 20 is a raised frame portion 32 which is formed from first and second raised members 34 and 36. The frame is completed with first, second, third, fourth and fifth straps 37-41, as explained hereinafter.

The first and second side members 22 and 24 are connected at their proximal ends 42 and 44 (nearest the front of the car) by a hinged connector 46 which allows the first and second side members to rotate relative to each other as demonstrated by arrow 47. Distal ends 48 and 50 of side members 22 and 24 are, in turn, connected at hinges 52 and 54 to end frame member 26.

The first and second side frame members 22 and 24 are generally mirror images of each other. Each is formed by two sections connected at a hinge. As shown, the first and second side frame members include proximal sections 66*a* and 66*b* and distal sections 68*a* and 68*b* which are pivotally connected together by a three-way hinge 70*a* and 70*b*.

First and second raised members 34 and 36 are likewise hingedly connected to three-way hinges 70*a* and 70*b* at first ends and at opposite ends are pivotally connected to each other at hinge 72. Internal frame members 28 and 30 are also hingedly connected at hinge 70*a* and 70*b* at the first ends and at opposite ends are connected at a hinge 76 which is a part of the end frame member 26.

End frame member 26 is formed from 4 separate sections or poles 78, 80, 82 and 84. Pole 78 is connected at one end to hinge 52 and at the second end to hinge 86. In turn, pole 80 extends from hinge 86 to hinge 76. Pole 82 extends from hinge 76 to hinge 88. Finally, pole 84 extends from hinge 88 to hinge 54. Thus, the four poles 78, 80, 82 and 84 form the end frame member 26.

Figure 6:
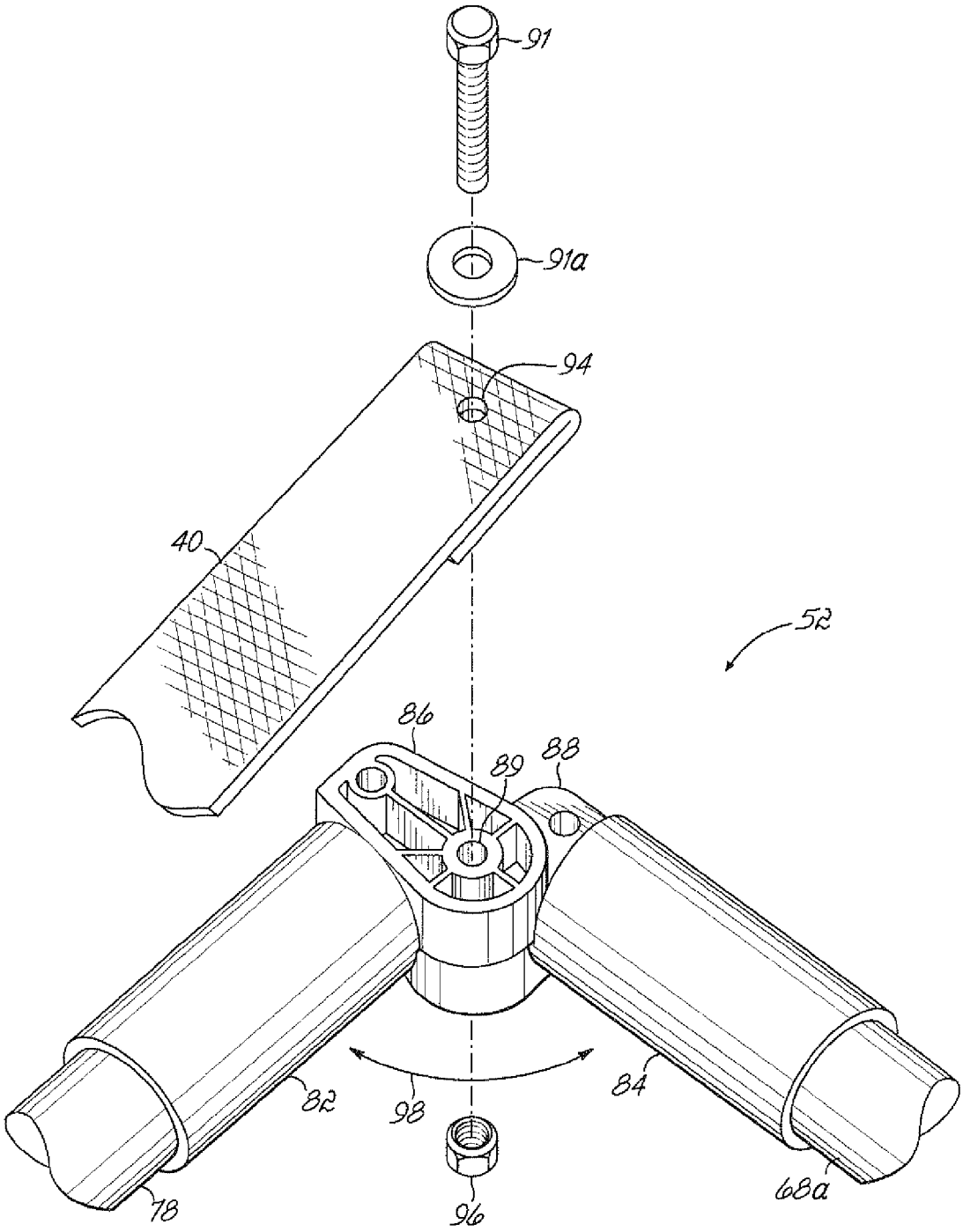
FIG. 6 is a perspective view of a second hinge used in the present invention.

Hinges 46, 52, 54 and 72 are all basically the same having first and second ends that fix to the frame sections and a flat section connected together by a hinge pin. The straps 38, 39, 40 and 41 are connected to the respective hinges. Straps 38, 40 and 41 all connect to the rear portion of hinge 72 and extend to hinges 76, 52 and 54, respectively. They attach to the hinges via the hinge pin or bolt, as shown in FIG. 6. Strap 39, in turn, runs from hinge 72 to hinge 46. As explained hereinafter, these straps simply provide added support for the cover.

Hinge 52 is shown in more detail in FIG. 6. This hinge connects frame members 78 and 68*a*. The frame members 78 and 68*a* fit into tubular members 82 and 84. The tubular members 82 and 84 include tear-drop-shaped ends 86 and 88. The enlarged portion of these tear-drop-shaped members includes aligned apertures 89 which receive a bolt 91 which extends through washer 91*a* and a hole 94 in strap 40. These bolts extend through the axial opening 90 and are held together with a nut 96. The tear-drop shaped ends 86 and 88 permit tubular member 82 to rotate in the direction of arrow 98 so that member 82 abuts against member 84 in the folded configuration.

Connectors or hinges 70*a* and 70*b* are mirror images of each other. Connector 70*a* is shown in more detail in FIG. 5. This connector connects frame member 28, 68*a*, 34 and 66*a*, allowing them to rotate relative to each other to allow the frame structure to extend folded to an extended position.

The connector 70*a* includes four tubular members 100, 102, 104 and 106. Frame members 66*a* and 68*a* are connected into tubular members 100 and 102. These tubular members both include tear-drop-shaped ends 108 and 110 and are connected by a pin 112. This allows the hinge member 102 to fold 180° up against tubular member 100 with tubular member 104 located between the two. The narrow portion of the tear-drop-shaped member includes an aperture 113 which is adapted to receive a locking pin 114 which holds the structure in the extended position, as is explained hereinafter.

Figure 2:
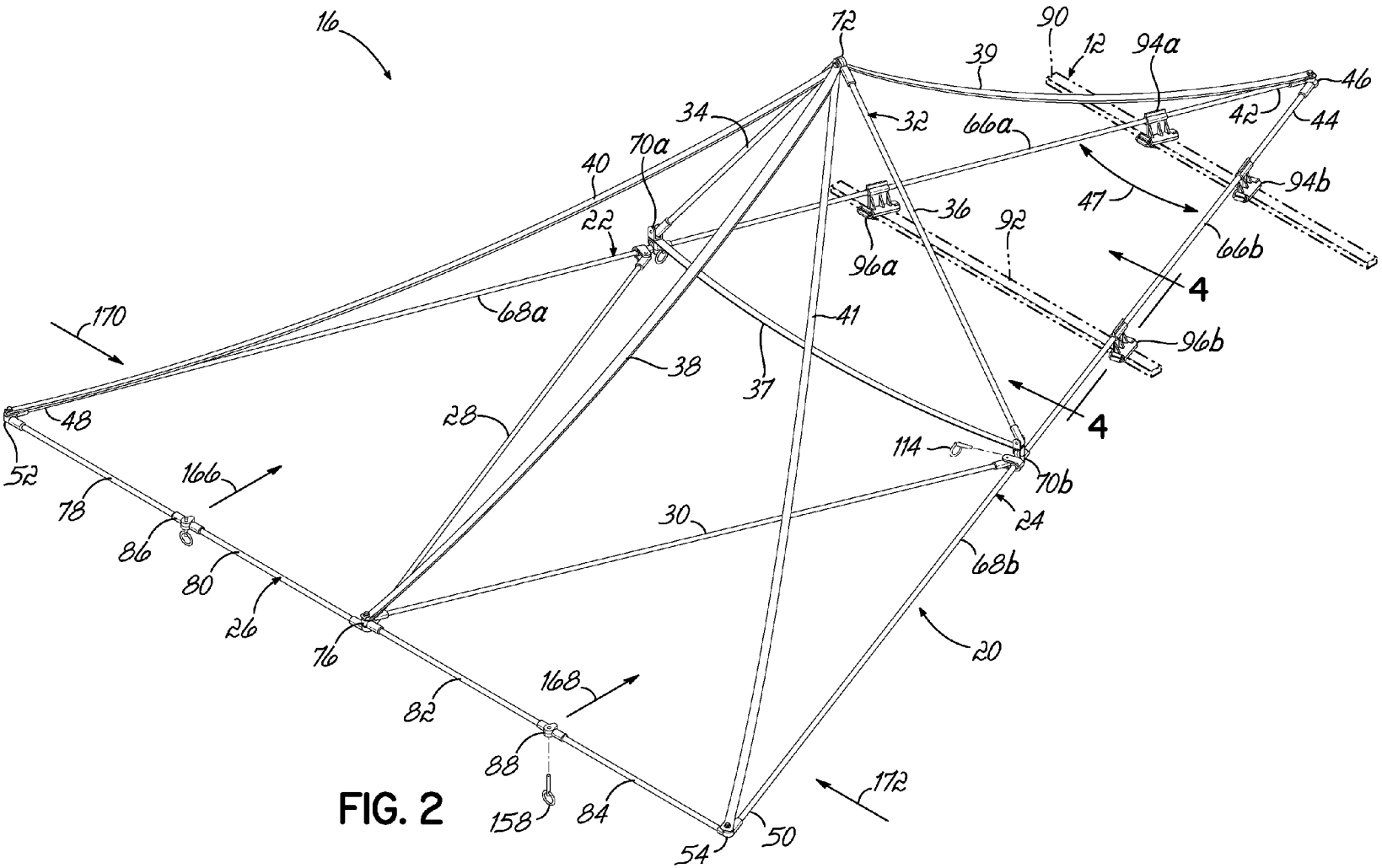
FIG. 2 is a perspective view of the frame used in the present invention in an extended position.
Figure 5:
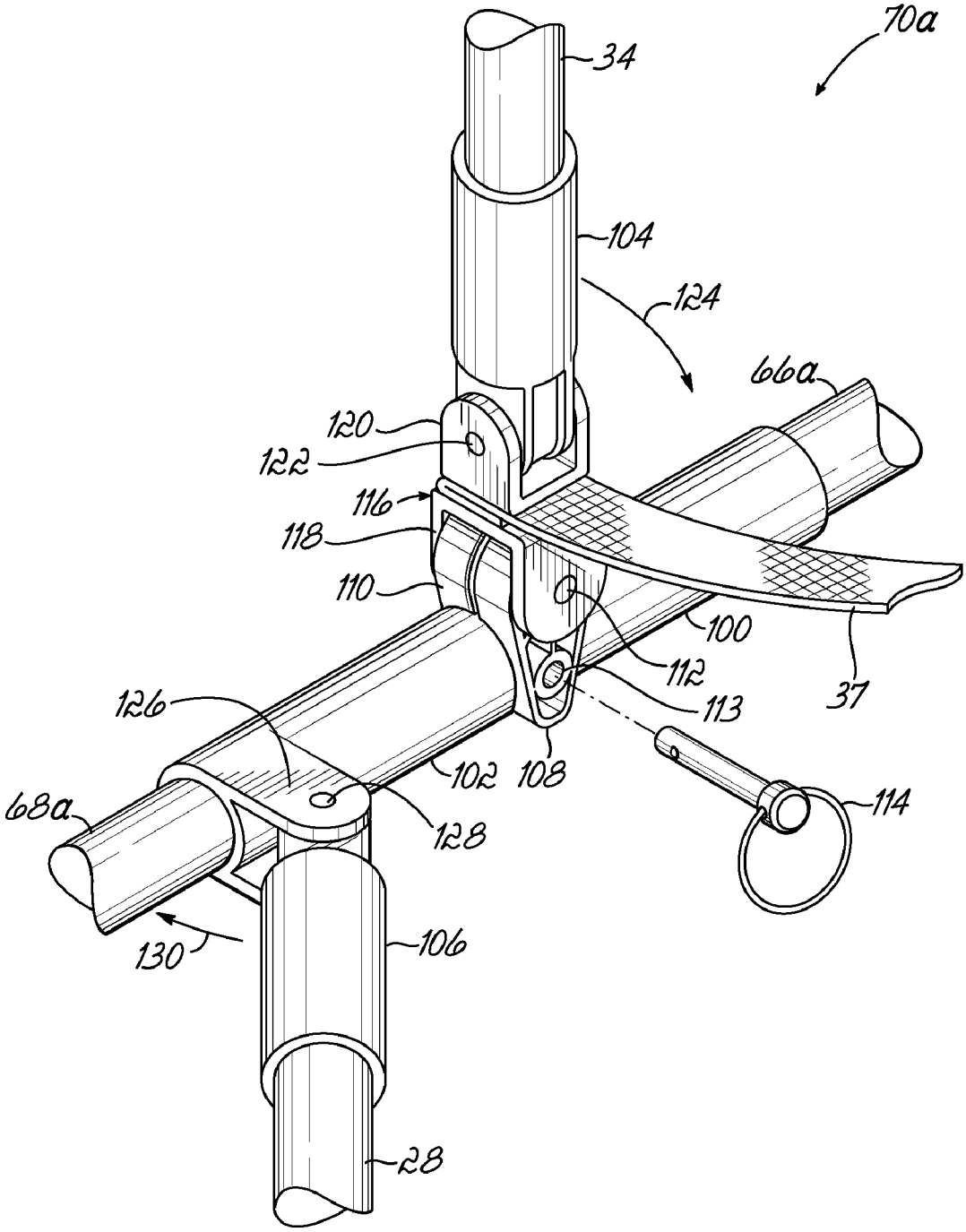
FIG. 5 is a perspective view of one of the hinges used in the present invention.

Connected to the tear-drop-shaped members 108 and 110 is a double offset U-shaped connector 116. This includes a first C-shaped collar 118, which is connected to the members 108 and 110 by pin 112, allowing free rotation. Connector 116 also includes an upper C-shaped collar 120 which is pivotally connected to member 104 with the pin 122. This allows the tubular member 104 to rotate in the direction of arrow 124. Finally, tubular connector 102 includes a connecting portion 126 at its end opposite the tear-drop-shaped portion. Tubular member 106 is pivotally connected to member 126 with pin 128, again allowing it to rotate in the direction of arrow 130. This connector 70*a* is a mirror image of connector 70*b* and connector 70*b* is designated with identical numbers. Strap 37 extends between connectors 70*a* and 70*b* as shown in FIGS. 2 and 5.

Figure 8:
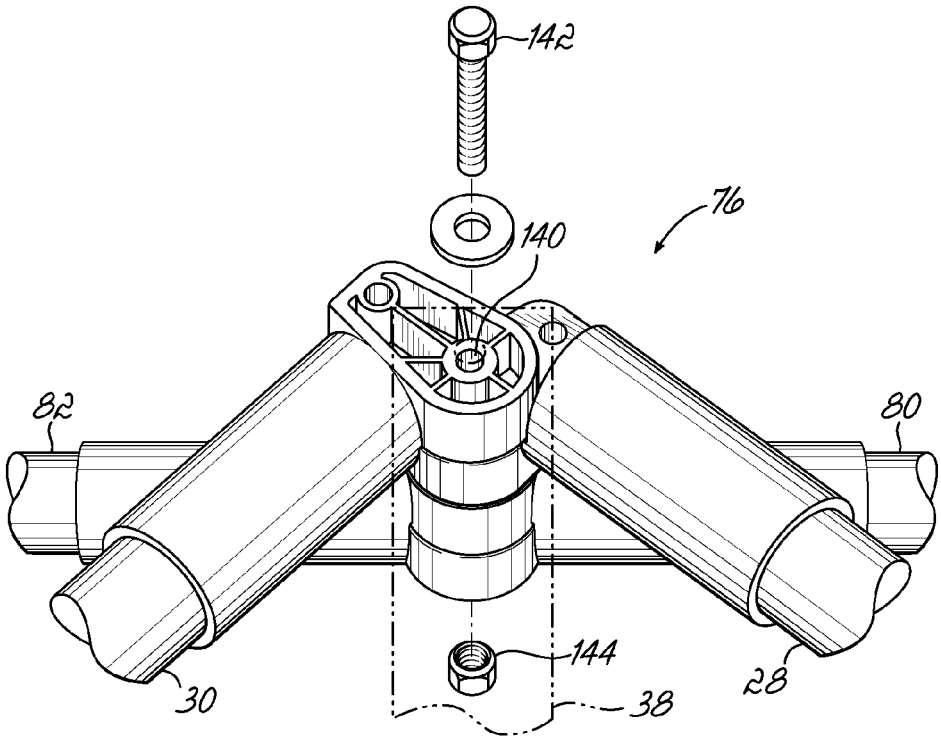
FIG. 8 is a perspective view of a fourth hinge.

The hinge 76 is shown more particularly in FIG. 8. This hinge allows frame members 80, 84, 28 and 30 to be pivotally connected. Each of the frame members 82, 80, 30 and 28 include a tubular portion with a tear-drop-shaped connector at the end. These are stacked together, as shown in FIG. 8, with the offset opening 140 aligned together. These, along with the strap 38, are held together by a bolt and nut, 142, 144.

Figure 7:
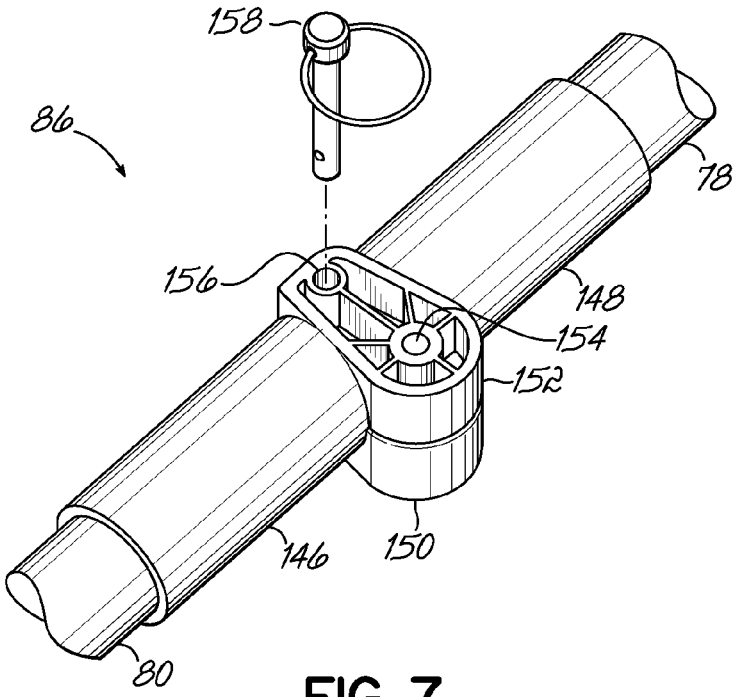
FIG. 7 is perspective view of a third hinge.

Finally, hinge 86 is shown more particularly in FIG. 7. It should be noted that hinge 88 is identical to hinge 86. Hinge 86 allows frame members 80 and 78 to be pivotally connected together. Again, these simply include tubular ends 146 and 148 with tear-drop-shaped portions 150 and 152. Bolt 154 pivotally connects these together. The tear-drop-shaped members 150 and 152 include a second opening 156 which allows for insertion of a locking pin 158, which holds these frame members together in an extended position.

The cover 18, as shown in FIG. 1, covers the entire frame with bottom edges affixed to the outer members of the triangle of the base frame. The cover is simply held in position with straps (not shown) that fit under the frame members. These include hook and pile fasteners which allow the cover to be tightened. The cover also includes a vent flap 162 as well as a plurality of water holes 104, which prevent water from accumulating in the cover.

The base frame maintains the bottom edge of the cover extended, whereas the upper frame portion, in combination with the straps, keeps the cover in a raised position. The straps may include adjustable buckles to allow additional tightening.

Figure 4:
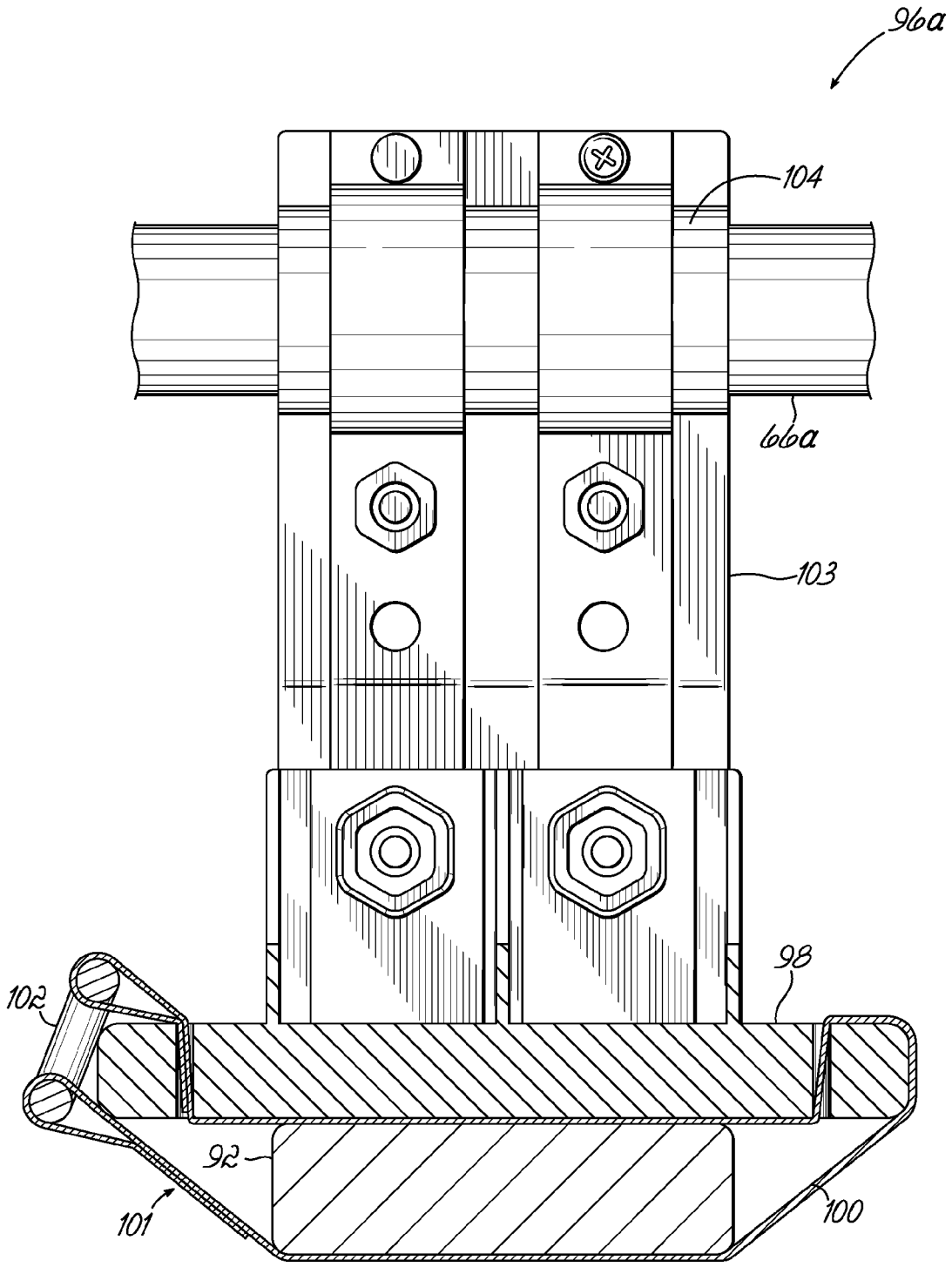
FIG. 4 is a plan view of the rear mounting feet partially in cross section.

As shown in FIGS. 1 and 2, the frame is attached to forward and rear staves 90 and 92 of the roof rack 12 with connectors 94*a* and 94*b*, and 96*a* and 96*b*. FIG. 4 shows a cross sectional view of one of the connectors 96*a*. As shown, this has a base portion 98 which includes a strap 100. The strap 100 includes preferably hook and pile type fasteners 101 or other type fasteners. As shown, the strap extends under stave 92 around a bar 102 and back upon itself to hold the base portion 98 to the stave 92. A raised portion 103 extends up from the base portion to a tubular member 104. Pole or frame section 66(*a*) is held within tubular member 104.

The base portion is designed so that it can slide on the stave. Also, the orientation of the base relative to the stave can change slightly to allow the base frame member to move, as shown by arrows 47. This connector is exemplary and any connector that would allow for the movement of the frame members as discussed hereinafter would work adequately. Brackets 94*a* and *b* are the same as brackets 96*a* and *b* except that the raised portions are shorter which causes the base frame to raise from hinge 46 to hinges 52 and 54.

Figure 3B:
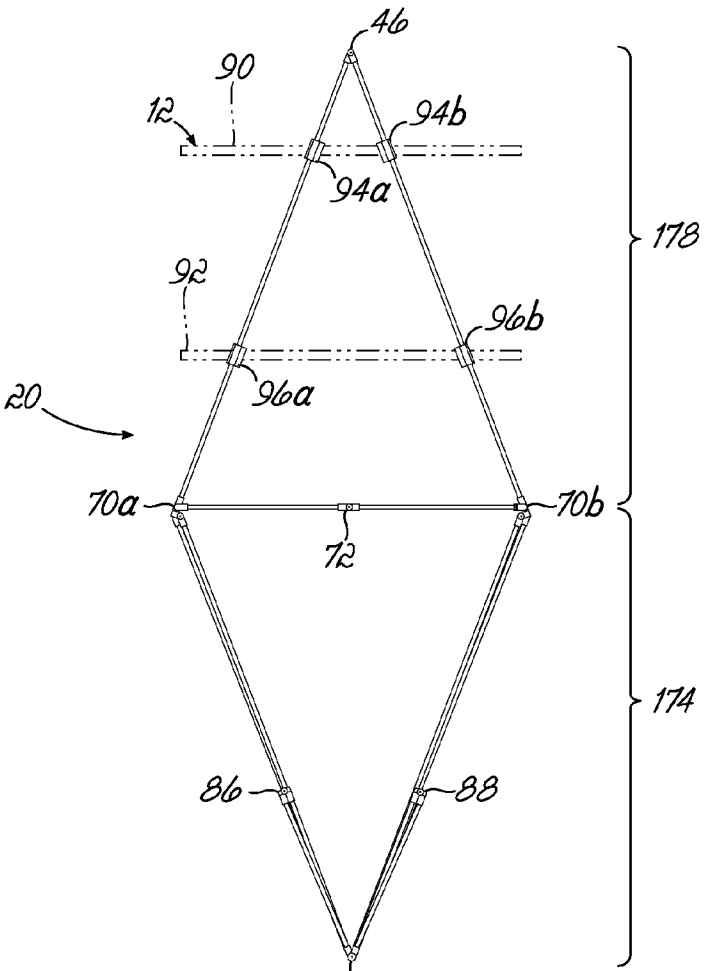
FIGS. 3A-3F illustrate how the frame is folded from an extended position to a storage position.
Figure 3A:
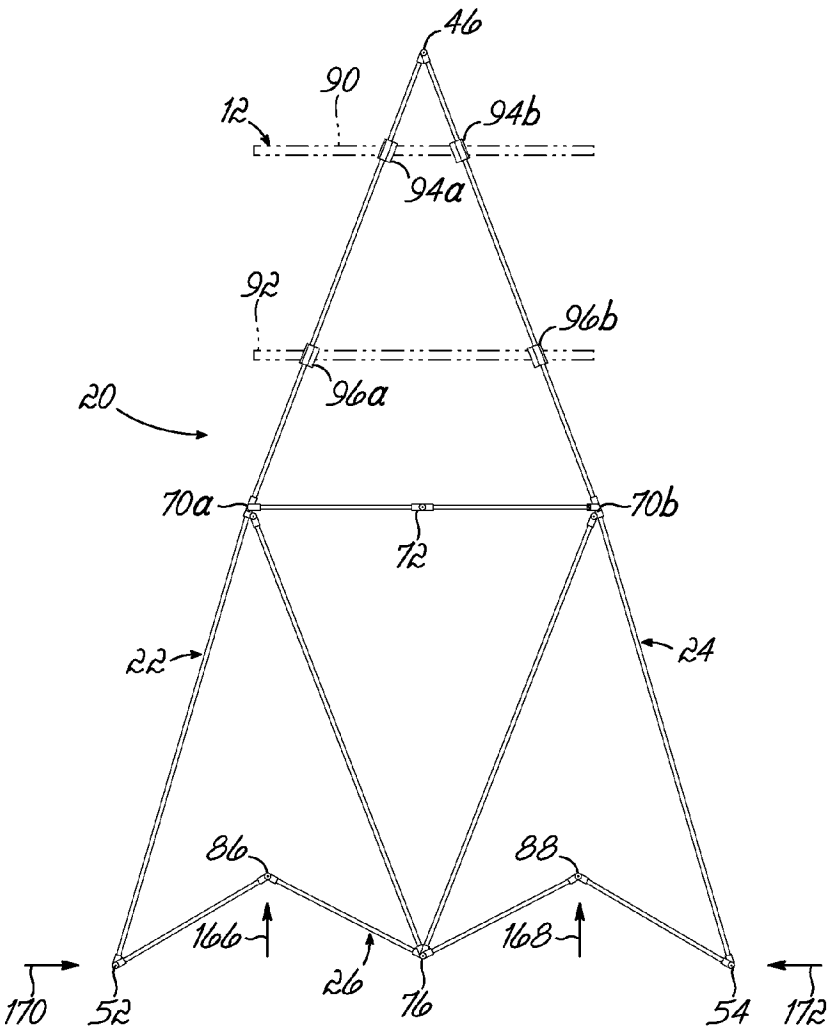
Figure 3C:
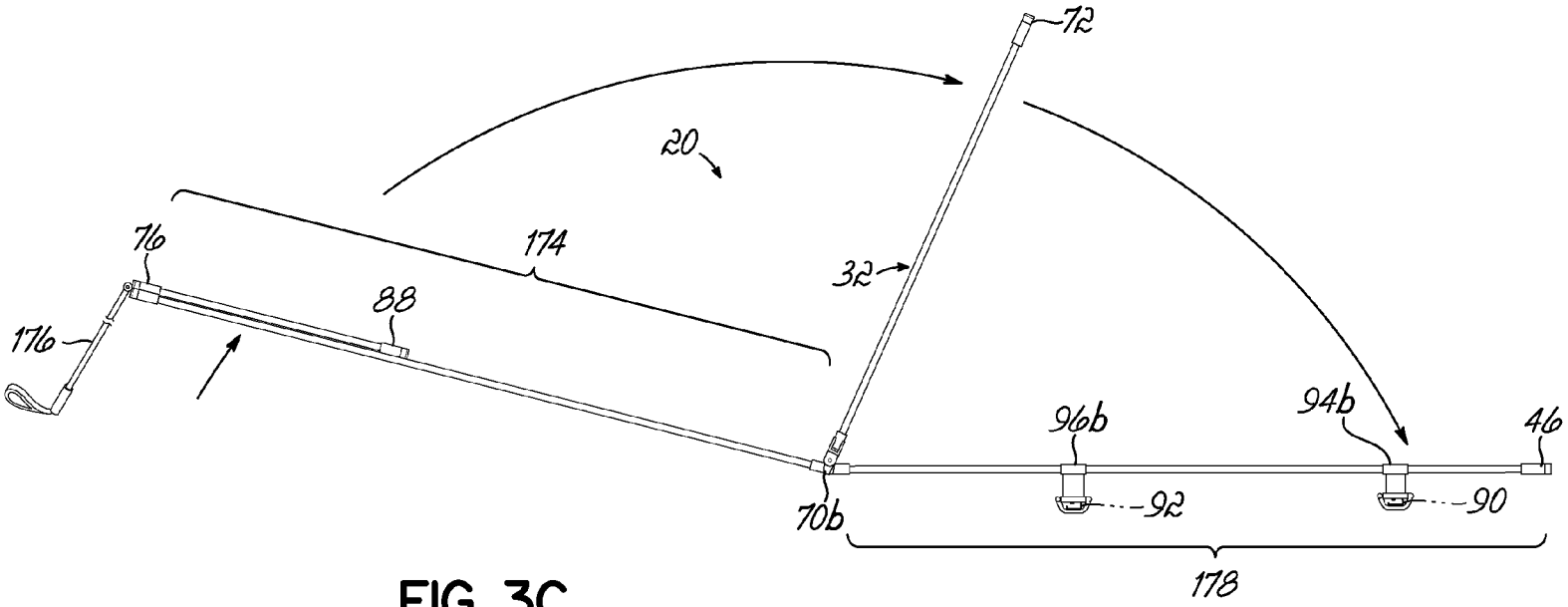
Figure 3D:
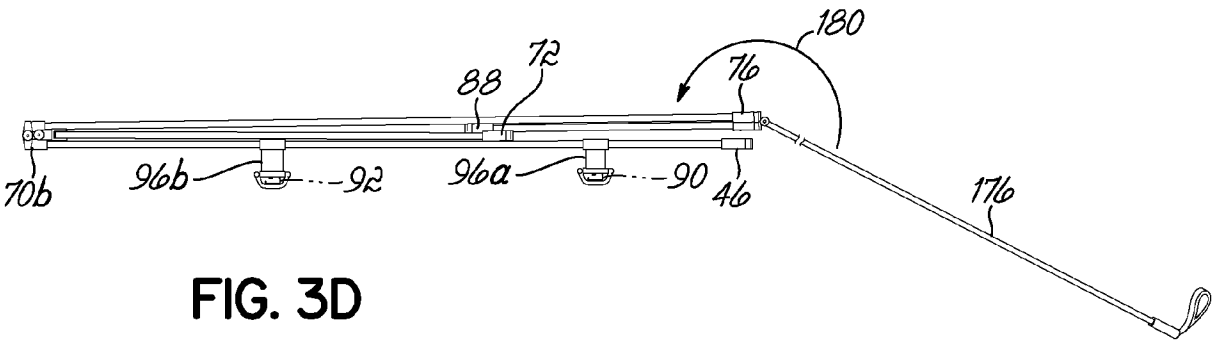
Figure 3F:
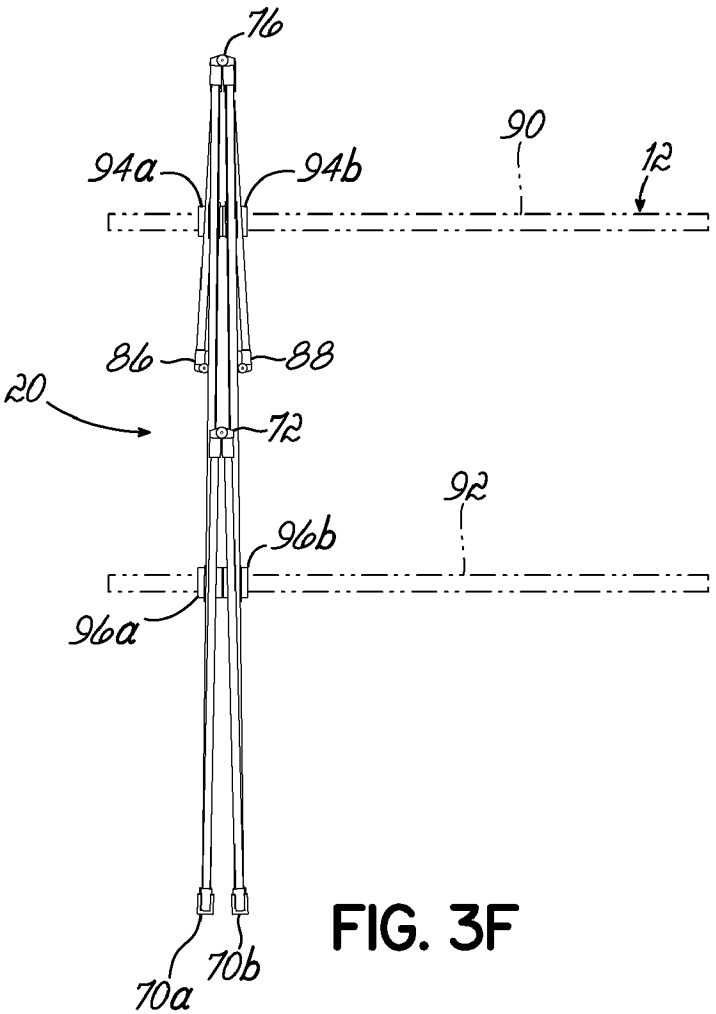
Figure 3E:
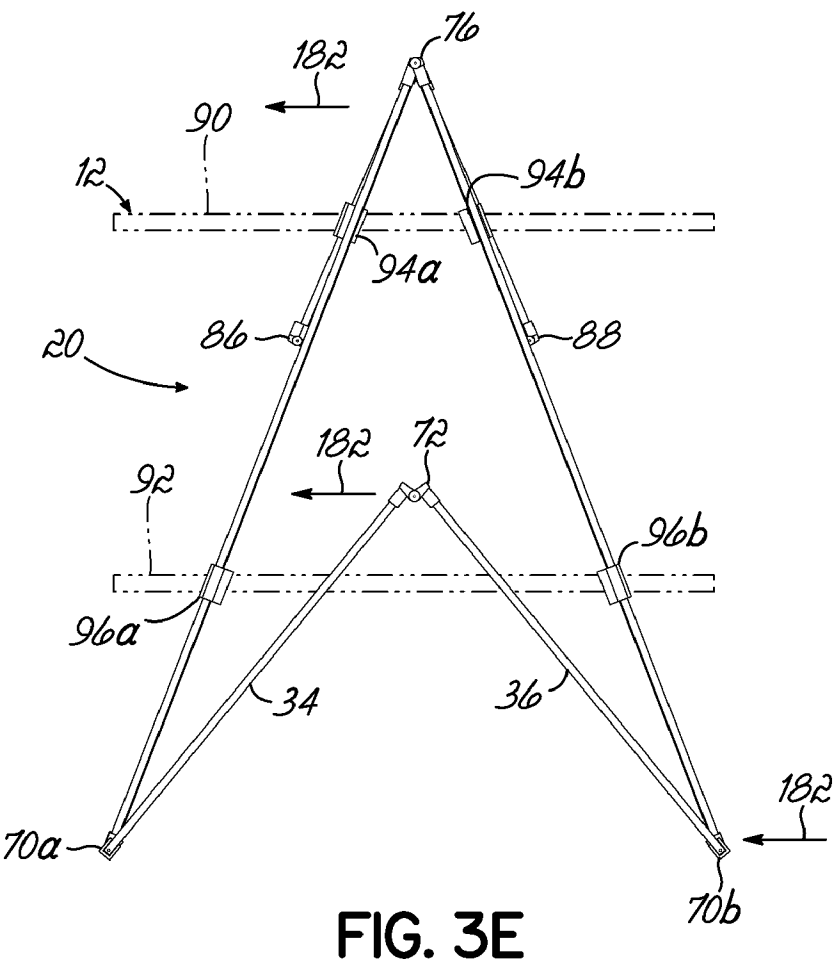

FIGS. 3A-3F demonstrate how the frame is converted from the extended position to the stored position and, of course, going from the stored position to the extended position is simply the opposite configuration. Initially, the four lock pins are removed from hinges 70(*a*), 70(*b*), 86 and 88. and the frame member 26 is accordioned by pushing in at hinges 86 and 88, as shown by arrows 166 and 168. At the same time, lateral pressure is applied to the side frame members, as shown by arrows 170 and 172, causing side frame members to pivot at hinges 70*a* and 70*b*, establishing the configuration as shown in FIG. 3B. In these drawings, the straps and cover have been removed for clarity. Next, the triangular rear portion 174 is pivoted 180° by pushing up on a pole 176 which is attached to hinge 76 see FIG. 3C). This portion folds up onto the raised portion of the frame both of which pivot about hinge 70*a* and 70*b* so that the distal triangular portion 174 rests on the proximal triangular portion 178. The pole is then rotated onto this section also, as represented by arrow 180 in 3D. Finally, one side of the frame is pulled toward the other side of the frame, as shown by arrows 182, bringing the frame together as shown in FIG. 3F. As this is occurring, the cover will, of course, fold upon itself. Base members 94*a*, 94*b* and 96*a* slide across the staves 90 and 92. As the frame assumes the final storage position, as shown in FIG. 3F.

Figure 9:
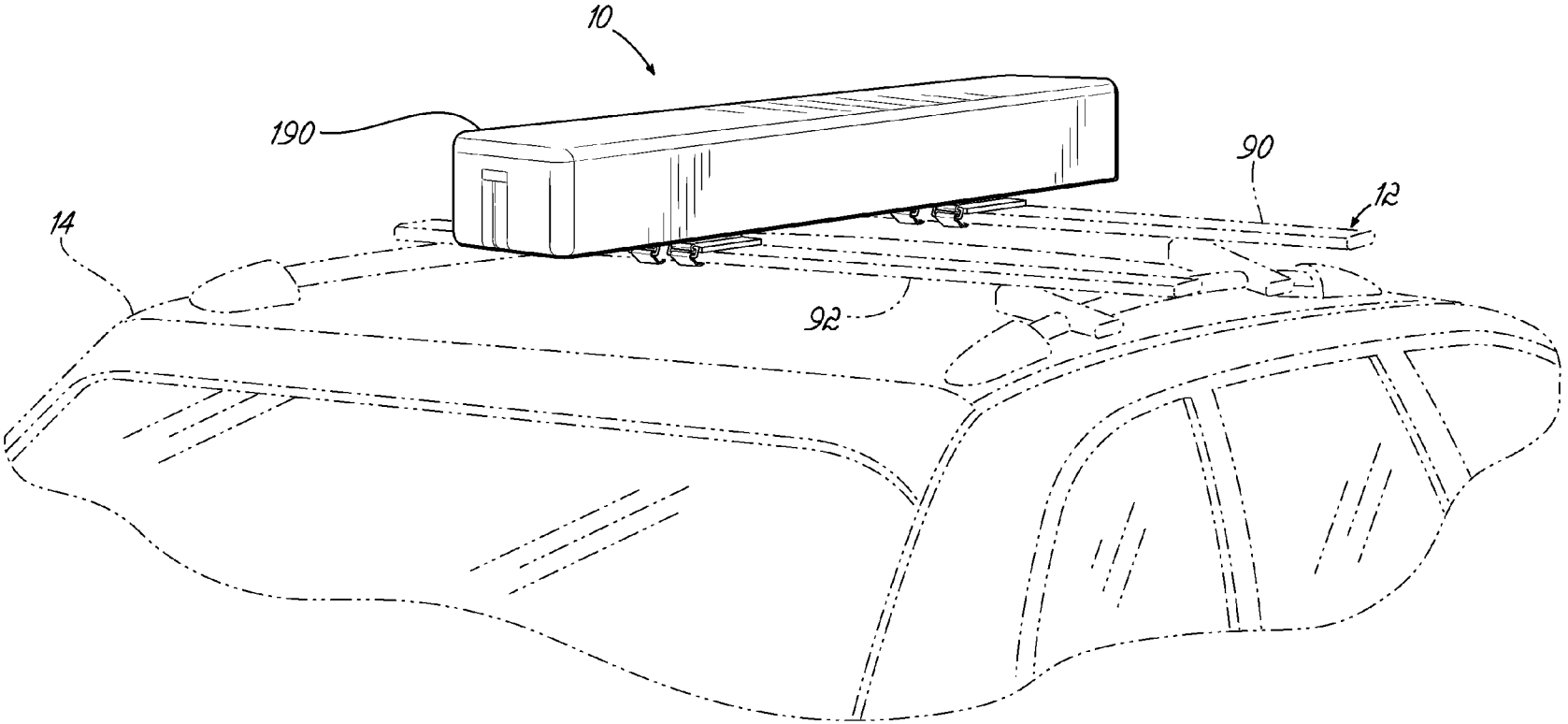
FIG. 9 is a view of the canopy of the present invention in a stowed position encased in a cover.

As shown in FIG. 9, fabric cover 190 fits over the folded structure and is held in place with fasteners (not shown) such as hook and pile fasteners or snaps. The cover, in turn, holds the frame together in locked position with the mounting brackets 94*a* and *b* and 96*a* and *b* still attached to the luggage rack so that one can drive away with the canopy safely attached to the motor vehicle in a stowed position.

This structure provides many different benefits. The canopy easily attaches to the motor vehicle allowing it to be installed quickly and easily. The structure is totally supported by the automobile without separate legs that people may run into and knock over. Because the canopy expands from the front of the motor vehicle towards the back of the automobile, it maximizes the size of the canopy. Further, the general frame structure itself provides for a sturdy, light-weight structure. The canopy can be further modified without departing from the present invention concept. The distal ends can be indirectly connected by a frame member forming a trapezoid or rectangle as opposed to a triangle. But, the cover would still function in the same manner.

This has been a description of the present invention along with the preferred method of practicing the present invention. However, the invention itself should only be defined by the appended claims, WHEREIN WE CLAIM:

What is claimed is:

1. A canopy structure including a frame and a cover;

said frame having first and second side frame members and an end frame member said end frame member having first and second ends fixed to distal ends of said side frame members wherein said side frame members each include a proximal section and a distal section and wherein said proximal sections are foldable onto said distal sections at first and second hinges allowing said side frame members to fold from a storage position to an extended position;

said end frame member having first and second hinges permitting said end frame member to fold from an extended position to a storage position;

said side frame members including proximal and distal mounting members attachable to proximal and distal laterally extended luggage rack staves wherein said mounting members are slidable relative to each other allowing said side frame members to slide from said storage position to said extended position;

proximal ends of said side frame members pivotally connected to each other;

first and second upper frame members pivotally connected to each other at first ends and having second ends one each pivotally attached at first ends and having second ends one each pivotally attachable to one each of said side frame members at said first and second hinges; and wherein said frame supports said cover when in said extended position.

2. The canopy structure claimed in claim 1 wherein said proximal ends of said side frame members are directly connected to each other.

3. The canopy structure claimed in claim 1 further comprising a first strap attached to first ends of said upper frame member and to said end frame member and a second and third strap one end of each strap attached to said first ends of said upper frame member and one end of each strap attached to one of said side frame members.

4. The canopy structure claimed in claim 1 wherein said upper frame members are foldable onto said proximal section of said side frame member.

5. The canopy structure claimed in claim 1 further comprising first and second internal frame members having first ends one each hingedly connected to one each of said first and second hinges and second ends of said internal frame member hingedly connected to said end frame member at a central hinge.

6. The canopy structure claimed in claim 1 wherein said distal ends of said side frame members are hingedly connected to said end frame member and proximal ends of said side frame members are hingedly connected to each other.

7. A canopy fixed to a motor vehicle roof comprising a frame and a cover;

said frame having first and second side frame members having proximal and distal sections foldable from a storage position to an extended position at first and second hinges;

said side frame members further having a plurality of brackets attached to said vehicle roof and slidable relative to each other from said storage position with said side members adjacent each other to said extended position in which at least portions of said side members are separated from each other;

said side frame members extend to an end frame member being cantilevered from said vehicle when said side frame members are in an extended position and further being collapsible when in a storage position; and an upper frame member comprising first and second vertical frame members hingedly connected to each other at upper ends and one each hingedly connected to said side frame members at lower ends wherein said frame supports said cover when in said extended position; and first and second internal frame members having first ends one each hingedly connected to one each of said first and second hinges and second ends of said internal frame member hingedly connected to said end frame member at a central hinge.

8. The canopy claimed in claim 7 further comprising a case adapted to encase said canopy while said canopy is fixed to said vehicle roof in a storage position.

9. The canopy claimed in claim 7 wherein said canopy is cantilevered from said roof over a rear of said vehicle when in said extended position.

10. The canopy claimed in claim 7 wherein said end frame member has four sections hingedly connected to each other allowing said four sections to accordion together.

11. The canopy structure claimed in claim 7 wherein said distal ends of said side frame members are hingedly connected to said end frame member and said proximal ends of said side frame members are hingedly connected to each other.

* * * * *